US005713296A

United States Patent [19]

Gervasi et al.

[11] Patent Number: 5,713,296

[45] Date of Patent: Feb. 3, 1998

[54] LIGHTWEIGHT CONCRETE DOCK

[76] Inventors: Paul R. Gervasi, P.O. Box 670, Lewiston, Calif. 96052-0670; Edward B. Lamkin, 445 Woodcliff Dr., Redding, Calif. 96003

[21] Appl. No.: 695,654

[22] Filed: Aug. 12, 1996

[51] Int. Cl.[6] ..... B63B 35/44

[52] U.S. Cl. ..... 114/266; 114/263

[58] Field of Search ..... 114/264, 266, 114/267; 405/218, 219

[56] References Cited

U.S. PATENT DOCUMENTS

| | | | |
|---|---|---|---|
| 3,487,710 | 1/1970 | Bethurem | 114/266 |
| 4,263,865 | 4/1981 | Shorter, Jr. | 114/266 |
| 4,318,361 | 3/1982 | Sluys . | |
| 4,353,320 | 10/1982 | Sluys . | |
| 4,709,647 | 12/1987 | Rytand . | |

FOREIGN PATENT DOCUMENTS

| | | | |
|---|---|---|---|
| 1501932 | 11/1967 | France | 114/266 |

*Primary Examiner*—Jesus D. Sotelo

[57] ABSTRACT

A lightweight concrete floating dock comprised of a plurality of main walkway floats and finger floats comprised of a lightweight but relatively strong concrete shell, a stout inner metal flame and a buoyant foam core. A grid of continuous steel reinforcing is embedded throughout the concrete shell. Utilities are enclosed in conduits within the shell or can be placed in an accessible alternative utility trench. Floats are connected using a hook and eye or swivel type of connection. Docks are positioned using metal cages extending out from opposite sides of floats supporting winch stands with cables attached to anchors along the harbor floor. A stout inner metal frame fitted against the inner side walls of the concrete shell is directly connected to metal elements used for connecting floats, mooring boats and positioning docks, such that all substantial external forces imparted to the dock are endured by the inner metal frame leaving the concrete shell crack and maintenance free.

7 Claims, 5 Drawing Sheets

LIGHTWEIGHT CONCRETE DOCK

FIELD OF THE INVENTION

This invention relates to a lightweight concrete floating dock employing a metal inner frame.

GENERAL DISCUSSION OF BACKGROUND

Concrete floating boat docks or marine floats are in common use. A variety of docks which utilize standard or lightweight concrete formed around a buoyant core have already been developed. Methods of providing utility services such as water, electricity and other desired utilities have been incorporated into a number of these docks.

Standard aggregate concrete docks are generally strong and long lasting, however they are extremely heavy and necessitate a relatively deep dock in order to achieve the necessary freeboard. Lightweight concrete docks or floats reduce the weight and therefor the required depth but have typically forgone the strength characteristics that are necessary to withstand the forces exerted on a dock by boats, cleats and dock positioning equipment.

A lightweight concrete float shown in U.S. Pat. No. 4,318,361 issued on Mar. 9, 1982 to Wesley W. Sluys discloses a concrete float which employs two varieties of concrete. A standard aggregate concrete is utilized on the surface of the float and a foam aggregate concrete made with polystyrene expanded beads are used on the side walls and bottom of the float. Due to the heavier concrete placed on the top of the dock additional weight and or concrete must be placed on the bottom of the dock in order to attain stability with a center of gravity below the center of buoyancy. The added weight defeats the purpose of a light weight dock.

The standard aggregate concrete surface provides a platform from which the float can withstand forces imparted to it by vessels and a means to secure floats to each other to produce a dock or pier. Conduits are placed longitudinally through the deck to provide an avenue for cables or tie rods to attach the floats together.

The lightweight, weak foam aggregate sidewalls and bottom are utilized in order to place the sidewalls and bottom in compression in lieu of tension. The foam aggregate concrete is about 85% the density of water. The lightweight, weaker concrete sides and bottom exert upward pressure on the float and provide floatation but the sides are susceptible to breakage due to hits from vessels which vary in size and shape and don't all meet the float at the stronger top layer of concrete.

U.S. Pat. No. 4,709,647 shows a floating dock which uses concrete sides and bottom to form a tub like structure filled with a buoyant material. A wooden structure incorporated to separate the deck from the core, provides a space for utilities. Compression rods place the upper portion of the dock in compression and hold the deck in place. This design provides substantial protection from the tensile forces which may be exerted on the upper portion of the dock but it provides little resistance to the compressive forces which may be exerted on it by waves or hits from large vessels.

U.S. Pat. No. 4,353,320 discloses a dock utilizing a marine float having a concrete casing surrounding a buoyant foam core. a utility trench extends longitudinally along the float. In the absence of a structural frame, the trench makes the dock structurally weak at the center of the deck.

All prior floating docks require that cleats, dock positioning equipment and other metal appurtenances be attached to the concrete or wooden surface of the deck. The repetitive stresses exerted on the deck through the metal attachments eventually cause breakage requiring extensive maintenance. None of the prior inventions relating to light weight concrete docks or floats utilize an inner metal frame to withstand such forces.

It is therefore an object of this invention to provide an improved floating, lightweight concrete dock which utilizes a stout inner metal frame to provide the necessary strength to withstand the forces exerted on the dock by connection assemblies, cleats and dock positioning equipment and to also withstand the tensile and compressive forces exerted on the dock by waves, boats and other elements.

Another object of the invention is to provide a dock which requires little or no maintenance.

Yet another object of the invention is to provide a lightweight concrete shell which has approximately 50% of the strength of standard aggregate concrete and about 60% the density of standard aggregate concrete that when combined with steel reinforcing can withstand the dynamic compressive and tensile forces exerted on the concrete shell.

It is still another object of the invention to provide a method of attaching floats together using metal elements attached to the metal inner frame.

A further object of the invention is to provide an avenue for utilities within the dock for marina services.

Yet another object of the invention is to provide a stable lightweight concrete dock with a center of gravity near or below the center of buoyancy without having to add unnecessary weight and materials.

These and other objects of the invention will become apparent from consideration of the ensuing description and drawings.

DETAILED DESCRIPTION OF THE PREFERRED EMBODIMENT

Figure 1:
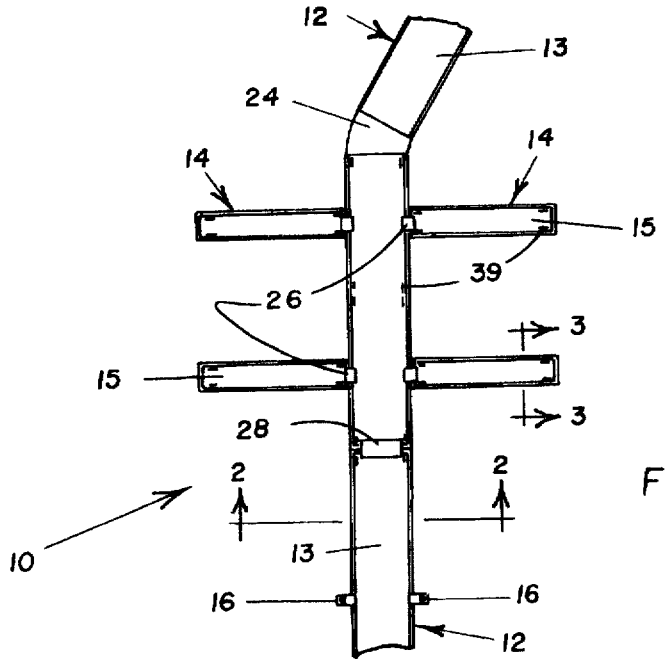
FIG. 1 is a top plan view of a moorage facility employing embodiments of the main walkway and finger sections of the present invention.

The lightweight concrete floating dock 10 as illustrated in FIG. 1 includes a main walkway 12 consisting of a plurality of main walkway floats 13 illustrated in FIGS. 2,4,5 and 6 and also a plurality of fingers 14 extending transversely thereto comprising one or more finger floats 15. Said dock is held in position with dock positioning equipment 16.

Figure 7:
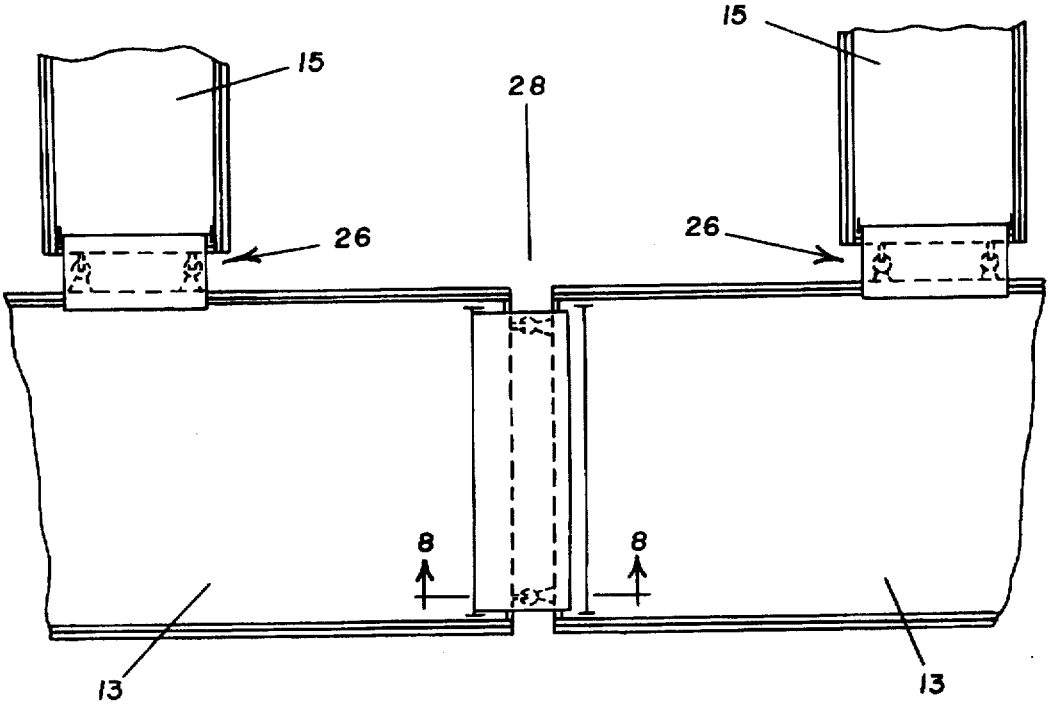
FIG. 7 is a top plan view of the hook and eye connection assembly between main walkway floats and also between main walkway floats and finger floats.
Figure 8:
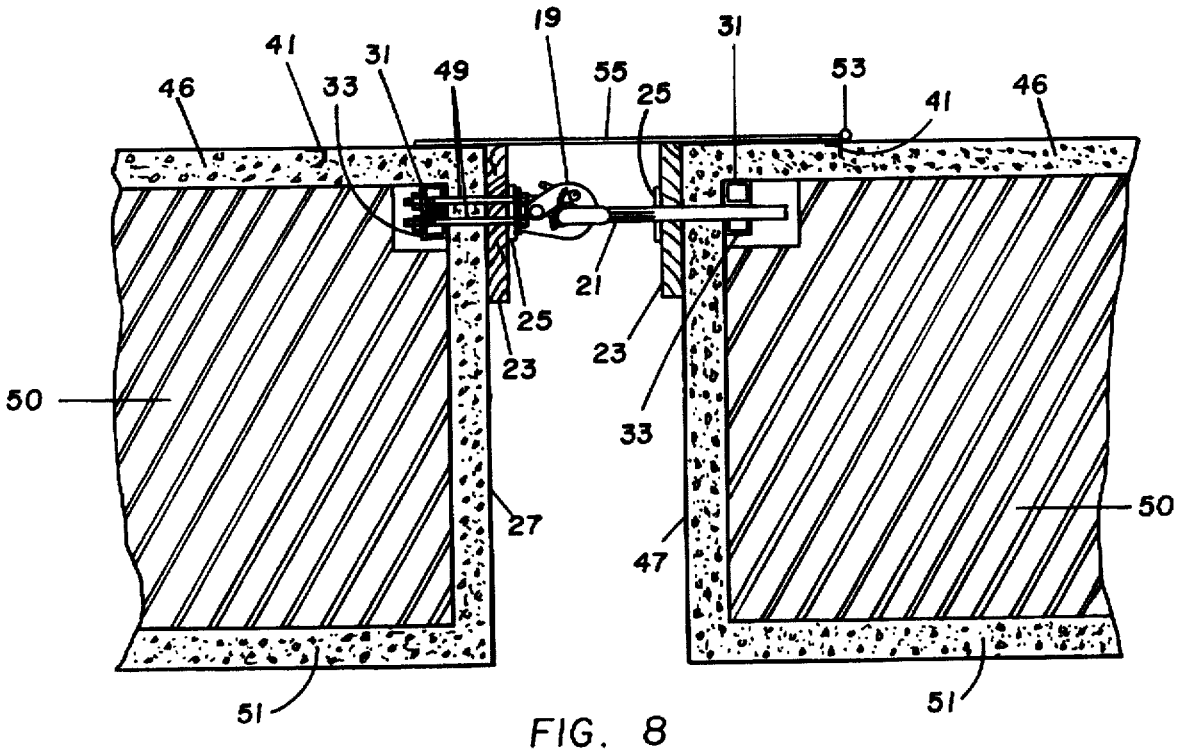
FIG. 8 is a cross-sectional view of the hook and eye connection assembly of FIG. 7 taken along section line 8—8.
Figure 9:
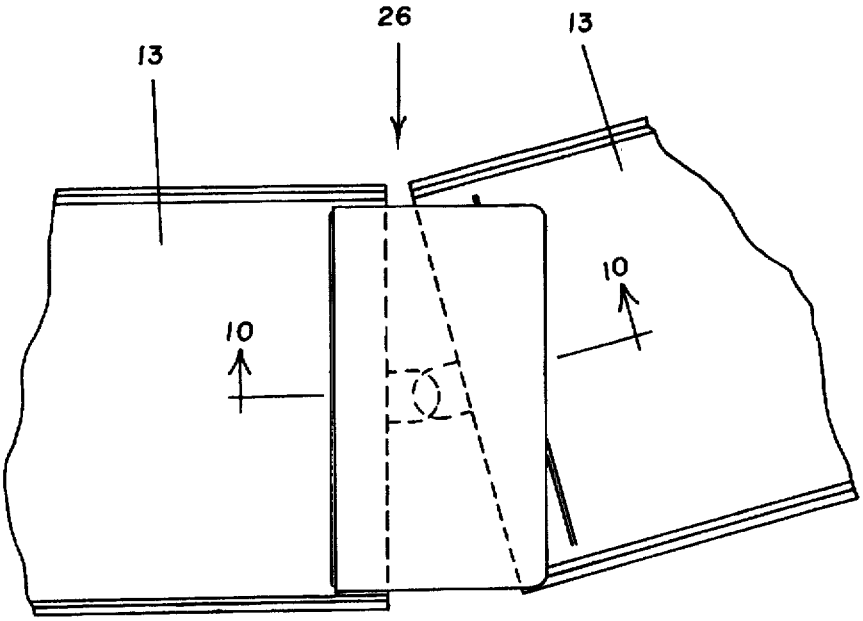
FIG. 9 is a top plan view of an alternative connection assembly, a swivel connection, between main walkway floats of the dock of FIG. 1.
Figure 10:
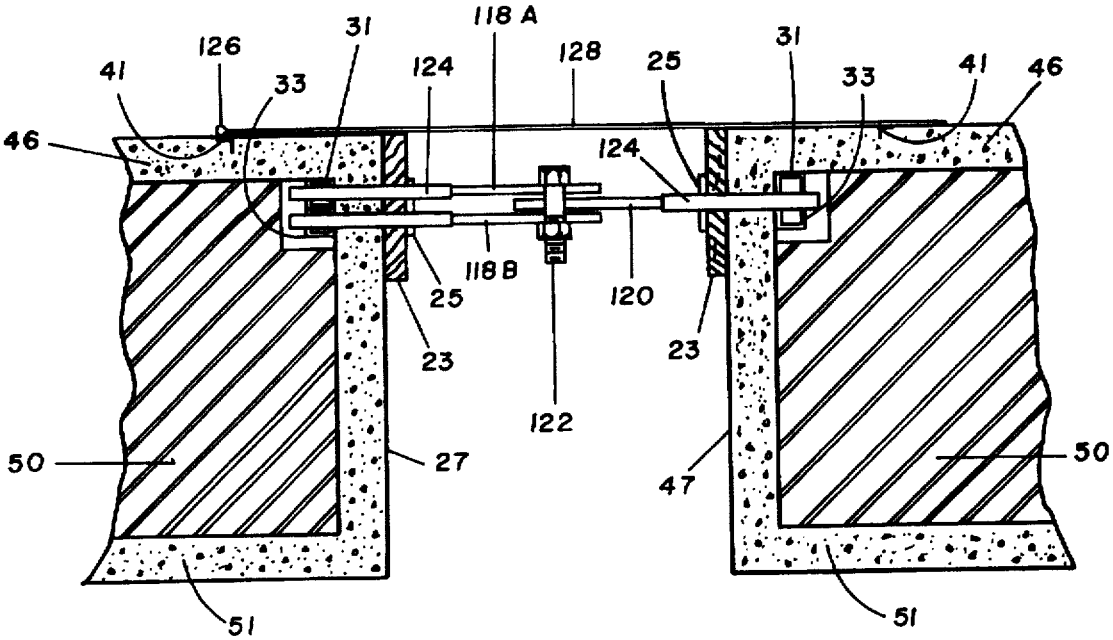
FIG. 10 is a cross-sectional view of a swivel connection assembly of FIG. 9 taken along section line 10—10.

Main walkway floats 13 are connected to each other in a lineal fashion with hook and eye connection assemblies illustrated in FIGS. 7 and 8 or in an angled fashion with a swivel connection illustrated in FIGS. 9 and 10. Finger floats 15 are connected transversely to main walkway floats 13 in the same manner as said main walkway floats are linearly connected to one another, with said hook and eye connection assembly further described herein.

Main walkway floats 13 have opposing sides 16,17 while finger floats 15 have opposing side 81,78. Boats are moored in a conventional manner within the rectangular section defined between the fingers 14.

Figure 2:
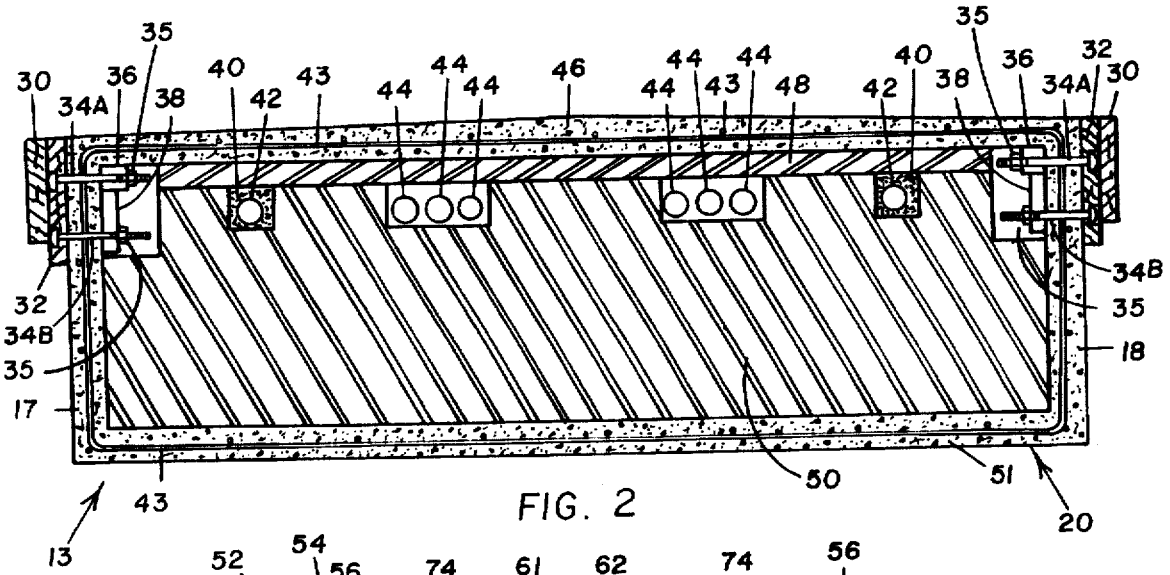
FIG. 2 is an enlarged cross-sectional view of a main walkway float of the dock taken along section 2—2 of FIG. 1.
Figure 4:
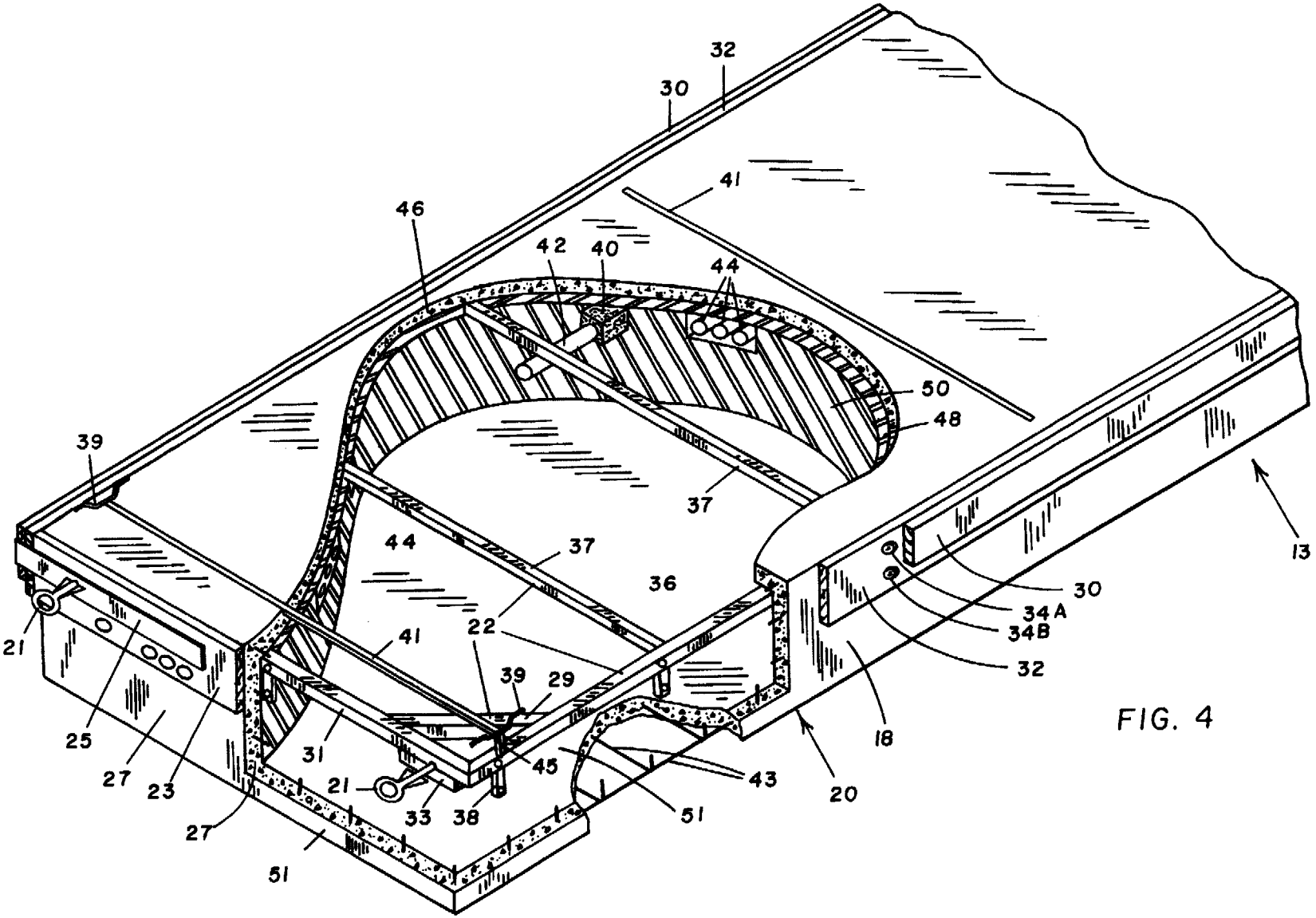
FIG. 4 is a fragmentary perspective view of a main walkway float of the dock of FIG. 1 with portions of the deck and sidewalls being cut away to show the metal inner frame and the arrangements of parts below the deck.

As best shown in FIGS. 1,2,4 the main walkway 12 includes a plurality of float modules 13 each float module comprising a lightweight concrete shell 20 enhanced by a metal inner frame 22. A buoyant foam core 50 such as expanded polystyrene foam, along with a top layer of foam 48, provides buoyant within the shell 20.

A lightweight aggregate concrete shell 20 comprising of lightweight aggregate such as volcanic rock, polystyrene beads, sand and cement, further comprising of a top 46 sloping outwardly from the center, two opposing sides 17,18, two opposing end walls 27,47 and a bottom 51. End wall 47 (FIG. 8,10) is identical to end wall 27 (FIGS. 4,8,10) but opposite and opposing. As shown in FIGS. 2 and 4 a continuous steel reinforcing grid 43 is embedded throughout said shell.

A main walkway float 13 is illustrated in greater detail in FIG. 4. After bottom 51, sides 17,18 and end walls 27,47 have been largely constructed and prior to construction of top 46 an inner metal frame 22 is welded in place fitting snugly against the inner side of said concrete shell side and end walls. An inner metal frame comprising of tubular steel support beams consists of side beams 36, end beams 31, cross beams 37 and corner supports 29. Various attachments are also described herein. All inner frame members and attachments are welded in place creating a strong frame or skeleton to withstand forces exerted on the dock by boats, dock connection assemblies 26,28 cleats 39, and dock positioning equipment 16.

Referring to FIGS. 2,4 in further detail, extending transversely from side beams 36 are a plurality of evenly spaced tubular steel cross beams 37. Protruding downward from side and end beams 36,31 are slightly smaller tubular steel supports 38 for attaching wale boards. Hardened steel bolts 34A,34B extend through wale board 32,23 concrete shell walls 17,18,27,47 and said metal inner frame. Upper bolt 34A extends through side and end beams 36,31. Lower bolt 34B extends through wale support 38. Hardened steel nuts 35 are welded on the inner sides of side beams 36, end beams 31 and wale supports 38 to facilitate future replacement of wale boards 32,23. Said wale boards encompass the main walkway float 13 flush with the deck surface. Said wale boards double as a form during pouring of the shell top 46. A rub board 30 nailed to the wale board 32,23 extends longitudinally along each side of the main walkway float 13.

Protruding upward from side beams 36 (FIG. 4) through and flush with concrete shell top 46 are tubular steel cleat and expansion joint supports 45. Said supports are welded to side beams 36. Cleats 39 and expansion joints 41 are welded to said supports. Cleats 39 are formed of cold rolled steel. Spacing of cleats is relative to the desired moorage locations.

A plurality of expansion joints 41 are placed as needed within the concrete shell top 46 to prevent concrete cracking due to expansive and contractive forces related to temperature. Comprised of angle iron, expansion joints 41 are cut and rejoined by welding at center span. The center slightly raised facilitates the formation of a well drained concrete deck with drainage directed outwardly from center.

As illustrated in FIGS. 2,4 a foam core 50 such as one pound per cubic foot expanded polystyrene fills the majority of voids within the concrete shell 20 providing necessary buoyancy. After the bottom 51 and sides 17,18 of the concrete shell 20 are poured and the inner metal frame 22 welded in place, the foam core 50 is placed on top of shell floor 51 and below inner metal frame 22. Elongated notches are cut longitudinally to provide runways for utility conduits 44 and gasoline conduit 42. Cement slurry 40 is poured surrounding gasoline conduit 42 as further protection against breaks and or leakage. Rigid conduits 44,42 extend the length of main walkway floats 13. Conventional flexible conduit (not shown) connects conduits between said main walkway floats.

Once foam core 50 and conduits 42,44 are placed, a foam layer 48 is placed over conduits 42,44 and foam core 50 and between cross beams 37. A foam layer 48 fills the majority of remaining voids and serves as the bottom form for pouring the concrete top 46.

Figure 3:
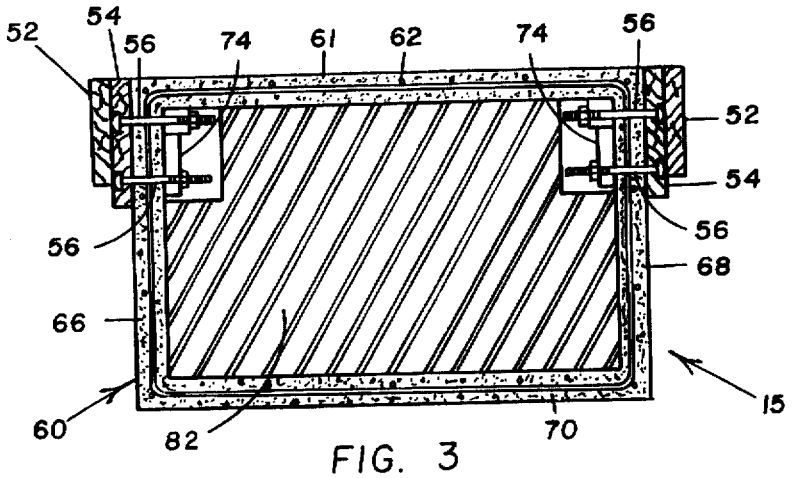
FIG. 3 is an enlarged cross-sectional view of a main finger float of the dock taken along section line 3—3 of FIG. 1.

Although a buoyant core 50 of buoyant foam is illustrated it is understood that other buoyant core structures could be used. For example the core 50 may be hollow so that the shell surrounds the hollow vessel or structure, Referring now to FIGS. 1,3,7 each finger 14 comprises at least one finger float 15 comprised of nearly the same features as the main walkway float 13. But approximately one half to one quarter the width of said main walkway float. Unlike the main walkway concrete shell 20, shell 60 comprises of a top 61 which is flat in lieu of outwardly sloped. Similar to the main walkway float 13, finger float 15 is fully enclosed by the lightweight concrete shell 60 with opposing side walls 66,68, a top 61, bottom 70 and two opposing end walls (not shown). Identical to reinforcing grid 43 (FIGS. 2,4), grid 62 is embedded within concrete shell 60. A buoyant foam core 82 similar to core 50 provides floatation. An inner metal frame 74 comprising of tubular steel end beams cross beams, corner supports, and cleat, wale and expansion joint supports all as previously described and shown for the main walkway float 13 in FIG. 4.

Referring now to FIG. 2, a wale board 54 encompasses the entire finger float, attached to the inner metal frame 74 with hardened steel bolts 56. A rub board 52 is nailed to said wale board traversing the length of the finger float 15 along each side.

Referring still to FIG. 4 and also now to FIG. 8,9 hook and eye connection assemblies 26,28 are illustrated connecting main walkway floats 13 in an aligned manner and finger floats 15 transversely to main walkway floats. Comprised of a pair of standard pentil hooks 19 and eye bolts 21 said floats and finger floats are connected in the manner similar to that used in the trucking industry for connecting trailers to trucks. Additional metal tubing 33 is welded to the base of end beam 31. The eye bolt 21 extends through metal face plate 25, wale board 23, concrete shell end wall 27, end beam 31 and metal tubing 33 welded from and back of tubing 31,33. The eye bolt 21 is also welded to the steel face plate 25. As further illustrated in FIGS. 7,8 standard pentil hook 19 is welded to steel face plate 25 and bolted to inner metal frame 22. Four hardened steel bolts per pentil hook extend through the base of pentil hook 19, steel face plate 25, wale board 23, end wall 47 and metal tubing 31,33. Steel deck plating 55 provides continuous decking over said connection assembly is welded to hinge 53 which in turn is also welded to expansion joint 41 holding said deck plating in place.

Finger floats 15 are attached transversely to main walkway floats 13 in nearly an identical manner as said main walkway floats are attached to each other. A steel face plate (not shown) similar to steel face plate 25 extends longitudinally along the side of said main walkway float extending past said pentil hooks and attached to the main walkway float 13 immediately outside of wale board 32 with the same hardened steel bolts 34A,34B which attach said wale board. Rub board 30 is cut away around the vicinity of said connection assembly providing a cross sectional illustration identical to that shown in FIG. 8.

To provide flexibility in formations of docks, an alternative to the hook and eye connection assembly 28, a swivel connection assembly 26, is illustrated in FIGS. 9,10. Steel plates 118A,118B comprised of substantial steel plating are welded in a spaced relationship whereby sandwiching steel plate 120. A substantial bolt and nut 122 provides the pivotal point. Steel plates 118A,118B,120 are welded to solid steel bars 124. Said steel bars are aligned adjacent too each side of said steel plates extending through steel face plate 25, whaler board 23, concrete shell end wall 27,47 and inner metal frame steel tubing 31,33. A hinge 126 welded to expansion joint 41 holds steel deck plating 128 in place providing a continuous deck across the connection.

Figures 5, 6:
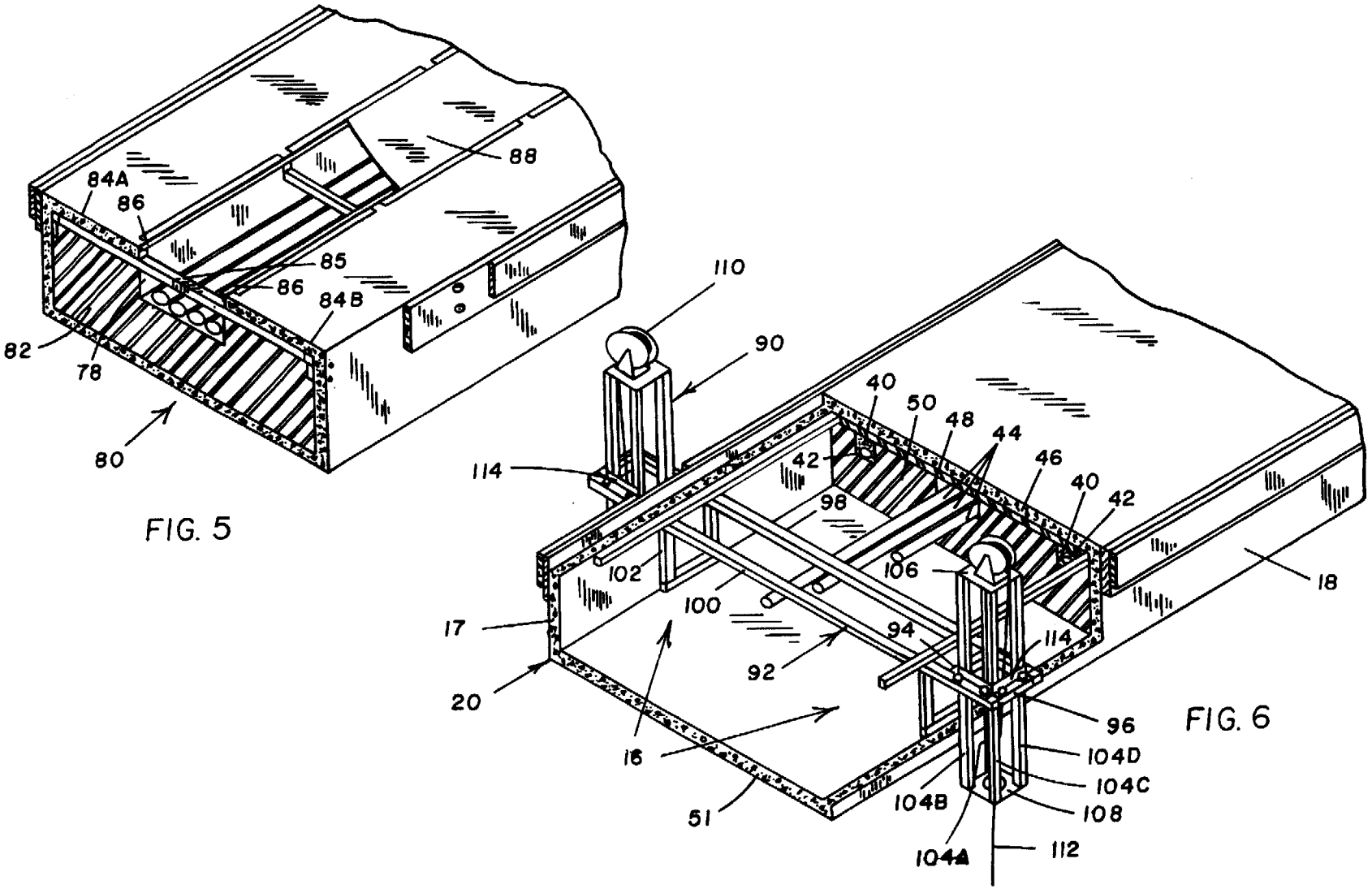
FIG. 5 is a fragmentary perspective view of an alternative main walkway float of the dock of FIG. 1, showing an alternative method of carrying utilities.
FIG. 6 is a fragmentary perspective view exposing the inner metal framing support of dock positioning equipment.

Illustrated in FIG. 5 is an alternative embodiment of a main walkway float 80. Said main walkway float is substantially similar to the main walkway float of FIGS. 1,2,4 with the exception of an elongated channel 78 extending the length of said float which provides an alternative avenue for utilities. Prior to placement of the foam core 82 and the concrete shell top 84A,84B, said sheet metal channel is tack welded to cross beams 85. The buoyant foam core 82 is placed under and around said sheet metal channel. Said channel also serves as a form during placement of the concrete shell top 84A,84B. Extending along both sides of the channel protruding inward immediately below said concrete shell top are angle iron supports 86. Said supports are placed such that the metal cover plate 88 sits flush with said concrete shell top.

Illustrated in FIG. 6 is dock positioning equipment 16 comprised of winch stand cages and winch stand frame 92, said winch stand frame comprises of substantial tubular steel beam 98,100 protruding outward through the concrete shell walls 17,18. Cross beam supports 94,96 are welded to steel beams 98,100 creating a square seat which facilitates placement of winch stand cages 90 which are dropped into position after assembly. Protruding downward from beams 98,100 and fitting snugly against concrete side walls 17,18 and floor 51 are tubular steel feet 102.

As illustrated in FIG. 6 the winch stand cage 90 comprises of four tubular steel members 104A,104B,104C,104D all of equal length in a spaced relationship welded to upper and lower steel plates 106,108 creating an elongated parallelepiped shaped cage. A top plate 106 comprised of steel plating provides a platform to attach a standard cable winch 110. A bottom plate 108 comprised of steel plating utilizes a hole centered in said plate to guide winch cable 112 downward therefore avoiding damaging contact between said cable and the concrete shell 20. Said cable connects to an anchor (not shown) on the harbor floor. Angle iron members 114 are welded transversely to tubular steel members 104A,104B,104C,104D at the midway point of the winch stand cage 90.

Once the winch stand cage 90 is complete it is dropped through the square opening in the winch stand frame created by tubular steel beams 94,96,98,100. Hardened steel bolts extend through said angle iron members and said beams to attach the winch stand cage 90 to the frame 92.

In lieu of said dock positioning equipment conventional means (not shown) may be used to secure the dock 10 to pilings or other structures.

The present invention enjoys a substantial advantage unknown in the prior art. Repetitive stresses and impact loads imparted on docks of prior inventions have been withstood by the decking material or the float module shell. Such forces eventually cause unsightly cracking and breakage around cleats, walers, winches and float connection assemblies. In the present invention all significant forces are directly imparted to the inner metal frame, leaving the light weight concrete shell crack and maintenance free.

I claim:

1. A floating lightweight concrete dock comprising: a plurality of main walkway and finger floats held in a fixed array, each float being comprised of a lightweight concrete shell including a top, utilized as a deck, sides and a bottom, all having interconnected and adjoining edges forming a closed interior chamber said chamber; filled with buoyant material to provide sufficient buoyancy to float said floats with the deck surface above the water, said walls and top, connected to and supported by an inner metal frame, said frame rigidly attached to float connection assemblies, including wales, cleats and dock positioning equipment: the improvement comprises: means for positioning said floating docks wherein said dock positioning equipment provides support for standard cable winches on the exterior of a float, said cable winches having cables attached to anchors on the harbor floor, said positioning equipment being used in conjunction with a series of floats connected on an end to end abutment relationship with a swivel connection assembly means permitting said floats to be arranged end to end in an angled fashion, and holding said floating dock in a desired array.

2. The invention defined in claim 1 wherein said dock positioning equipment providing support for standard cable winches on the exterior of opposing sides of a float comprises a winch stand frame including similar and parallel tubular steel beams fixed to a metal inner frame and extending through the interior of said float and protruding outward from the exterior of the side walls of said float joined at the ends and held in a spaced relationship by cross beam supports, additional cross beam supports being placed parallel to and inward from end cross beams in a manner creating square seating for opposing winch stand cages.

3. The invention defined in claim 2 wherein said winch stand frame includes a plurality of steel feet extending downward from said tubular steel beams fitting snugly against the inner walls and floor of said float.

4. The invention defined in claim 2 wherein said winch stand cage comprises, a plurality of parallel tubular steel members of equal length, upper and lower steel plates, all rigidly fixed to create a parallelepiped shaped cage, L shaped members rigidly attached transversely to said tubular steel members at or near the midpoint of said cage as a means of attachment to said winch stand frame.

5. The invention defined in claim 4 wherein said lower steel plate comprises a means of guiding a winch cable down and away from the underside of a float.

6. The invention defined in claim 4 wherein the upper steel plate provides a platform means of placing a standard cable winch.

7. The invention defined in claim 1 wherein said swivel connection assembly means comprises, a first and second float placed on an end to end relationship at a variable angle comprising an assembly unit wherein two substantial steel plates protrude in a spaced relationship from a first float sandwiching a similar steel plate protruding from a second float, said plates having aligned circular holes in which a substantial bolt is placed providing a pivot point between said first float and said second float.

* * * * *